US007857442B2

(12) United States Patent
Rabbani et al.

(10) Patent No.: US 7,857,442 B2
(45) Date of Patent: Dec. 28, 2010

(54) HEATED FOLDING SYSTEM FOR A PHASE CHANGE INK IMAGING DEVICE

(75) Inventors: Mojgan Rabbani, Pittsford, NY (US); David A. Mantell, Rochester, NY (US); Michael Jon Levy, Webster, NY (US); Jason Matthew LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 129 days.

(21) Appl. No.: 12/254,162

(22) Filed: Oct. 20, 2008

(65) Prior Publication Data

US 2010/0097434 A1 Apr. 22, 2010

(51) Int. Cl.
*B41J 2/01* (2006.01)

(52) U.S. Cl. ..... 347/104; 347/101; 270/58.07

(58) Field of Classification Search ..... 347/104, 347/101; 270/58.07
See application file for complete search history.

(56) References Cited

U.S. PATENT DOCUMENTS

| | | | | |
|---|---|---|---|---|
| 3,873,082 | A | 3/1975 | Imaizjmi et al. | |
| 4,679,474 | A | 7/1987 | Lambrecht | |
| 5,045,044 | A * | 9/1991 | McPherson et al. | 493/328 |
| 5,349,890 | A | 9/1994 | Butkus et al. | |
| 5,379,962 | A | 1/1995 | Albrecht et al. | |
| 5,810,279 | A | 9/1998 | Rodriguez et al. | |
| 6,476,146 | B2 * | 11/2002 | Matzinger | 525/210 |
| 6,855,101 | B2 * | 2/2005 | Trovinger et al. | 493/445 |
| 2005/0036023 | A1 * | 2/2005 | Costanza et al. | 347/104 |
| 2006/0180273 | A1 | 8/2006 | Beck | |
| 2007/0120312 | A1 | 5/2007 | Trovinger et al. | |
| 2008/0106025 | A1 | 5/2008 | Padros et al. | |

FOREIGN PATENT DOCUMENTS

| | | |
|---|---|---|
| EP | 0313039 | 4/1989 |
| EP | 1506873 | 2/2005 |

OTHER PUBLICATIONS

European Search Report, European Patent Office, Munich, DE, Jan. 29, 2010, 9 pages.

* cited by examiner

*Primary Examiner*—Matthew Luu
*Assistant Examiner*—Rut Patel
(74) *Attorney, Agent, or Firm*—Maginot, Moore & Beck LLP

(57) ABSTRACT

A folding system includes a media pathway configured to transport a print substrate having phase change ink thereon. The folding system includes a folding apparatus disposed along the media pathway configured to fold the print substrate. A folding heater is configured to heat the phase change ink on the print media to a folding temperature. The folding temperature is above ambient temperature and below a melting temperature for phase change ink.

15 Claims, 6 Drawing Sheets

HEATED FOLDING SYSTEM FOR A PHASE CHANGE INK IMAGING DEVICE

TECHNICAL FIELD

This disclosure relates generally to imaging devices, and, in particular, to sheet folding systems used in imaging devices.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, e.g. around 25° C., but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

Once melted phase change ink has been deposited on a recording medium, the recording medium may be transferred, delivered, or otherwise moved to a finishing device, or finisher. A "finisher" can be any post-printing accessory device such as a tray or trays, sorter, mailbox, inserter, interposer, stapler, stacker, hole puncher, collator, stitcher, binder, envelope stuffer, postage machine, or the like. In addition, the finisher may include a folding apparatus. The folder apparatus can be any combination of hardware elements that enables the print media to be folded. Mechanical folding of sheets involves doubling the sheet between rollers while applying pressure appropriate to the thickness of the paper to create a sharp fold that substantially eliminates the paper's natural tendency to revert to its original shape. In various exemplary embodiments, the folding apparatus can include any hardware elements, such as fold blades, one or more simple buckle folders, one or more sets of drive rollers, etc, that enable various types of folds to be controllably applied to each sheet on a sheet-to-sheet basis. The type of folds performed by the folder apparatus may include, but is not limited to, c-folds, z-folds, and half-folds.

One difficulty faced in folding print media that have been printed with phase change ink, however, is the breaking or flaking off of ink from the print media. For example, folding operations in a finishing system are typically performed at a rather high rate of speed which may cause solid ink to break and subsequently flake off because the solid ink material cannot respond quickly enough to the folding operation. In addition, ink breaking or flaking due to folding may result because phase change ink tends to be deposited primarily on the surface of the print media. Therefore, folding the print media may cause solidified phase change ink that has solidified on the surface of the media to break or flake off the media.

SUMMARY

In order to prevent or reduce the breaking or flaking of phase change ink during folding of a print substrate, a folding system has been developed that includes a media pathway configured to transport a print substrate having phase change ink thereon. The folding system includes a folding apparatus disposed along the media pathway configured to fold the print substrate. A folding heater is configured to heat the phase change ink on the print media to a folding temperature. The folding temperature is above ambient temperature and below a melting temperature for phase change ink. In some embodiments, the folding temperature is above ambient temperature and below an ink offset temperature.

In another embodiment, a method of folding a print substrate having phase change ink thereon comprises transporting a print substrate along a media pathway to a folding apparatus, the print substrate having phase change ink thereon; heating the phase change ink on the print media to a folding temperature that is above ambient temperature and below a melting temperature for the phase change ink prior to the substrate being folded; and folding the print substrate using the folding apparatus.

In yet another embodiment, a phase change ink imaging device is provided that includes a print station configured to deposit melted phase change ink on a print substrate. The melted phase change ink being configured to solidify after being deposited on the print substrate to form images on the print substrate. A folding apparatus is configured to receive the print substrate from the print station. The folding apparatus is configured to fold the print substrate having the phase change ink thereon. A folding heater is configured to heat the phase change ink on the print substrate to a folding temperature. The folding temperature is above ambient temperature and below a melting temperature for phase change ink.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
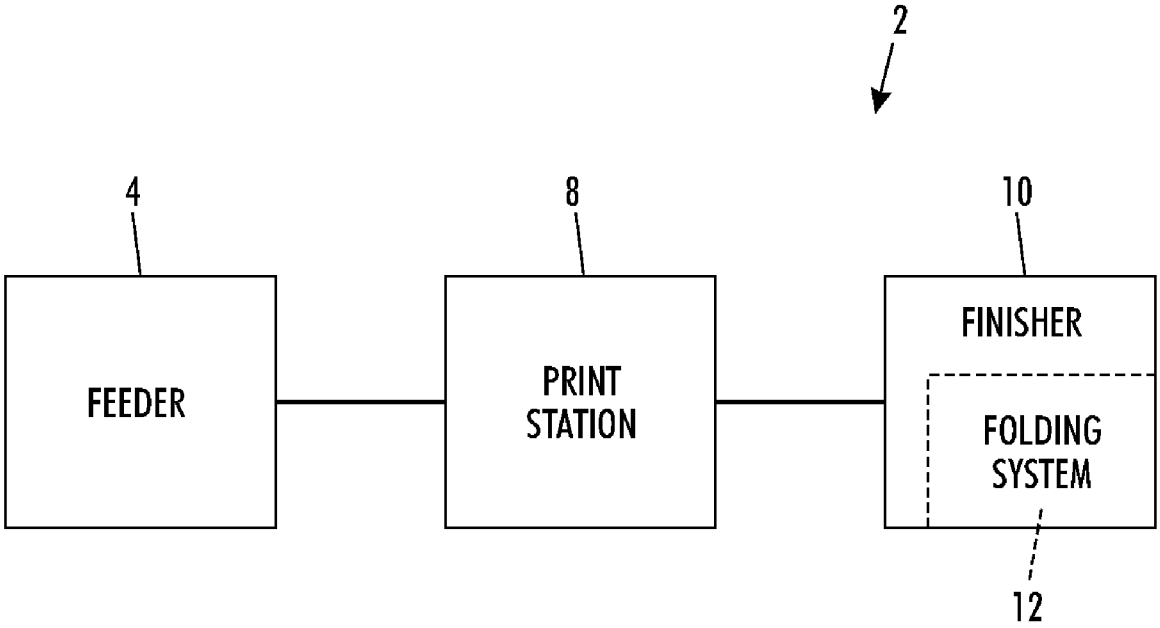
FIG. 1 is a block diagram of an embodiment of a phase change ink imaging device.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

An embodiment of a phase change ink imaging device 2 is depicted in FIG. 1. The exemplary imaging device includes a print station 8 that has at least one phase change ink printhead for emitting melted phase change ink onto print media to form images. The print station 8 is interposed between a feeder 4 and a finisher 10. The print station 8 is fed with print media from the feeder 4 as is known in the art. For example, the feeder 4 may include a plurality of print media sources such as trays (not shown). Each feeder tray, may include print media having different attributes such as roughness, coats, weights and the like. The print media may be substantially any type of media upon which the printhead modules may print, such as: high quality bond paper, lower quality "copy" paper, overhead transparency sheets, high gloss paper, etc. The imaging device can have a modular architecture which allows one or more print station, feeder and finisher to be replaced and/or interchanged as needed. Alternatively, the print station, feeder and finisher may be positioned integrally within a single device or machine.

Figure 2:
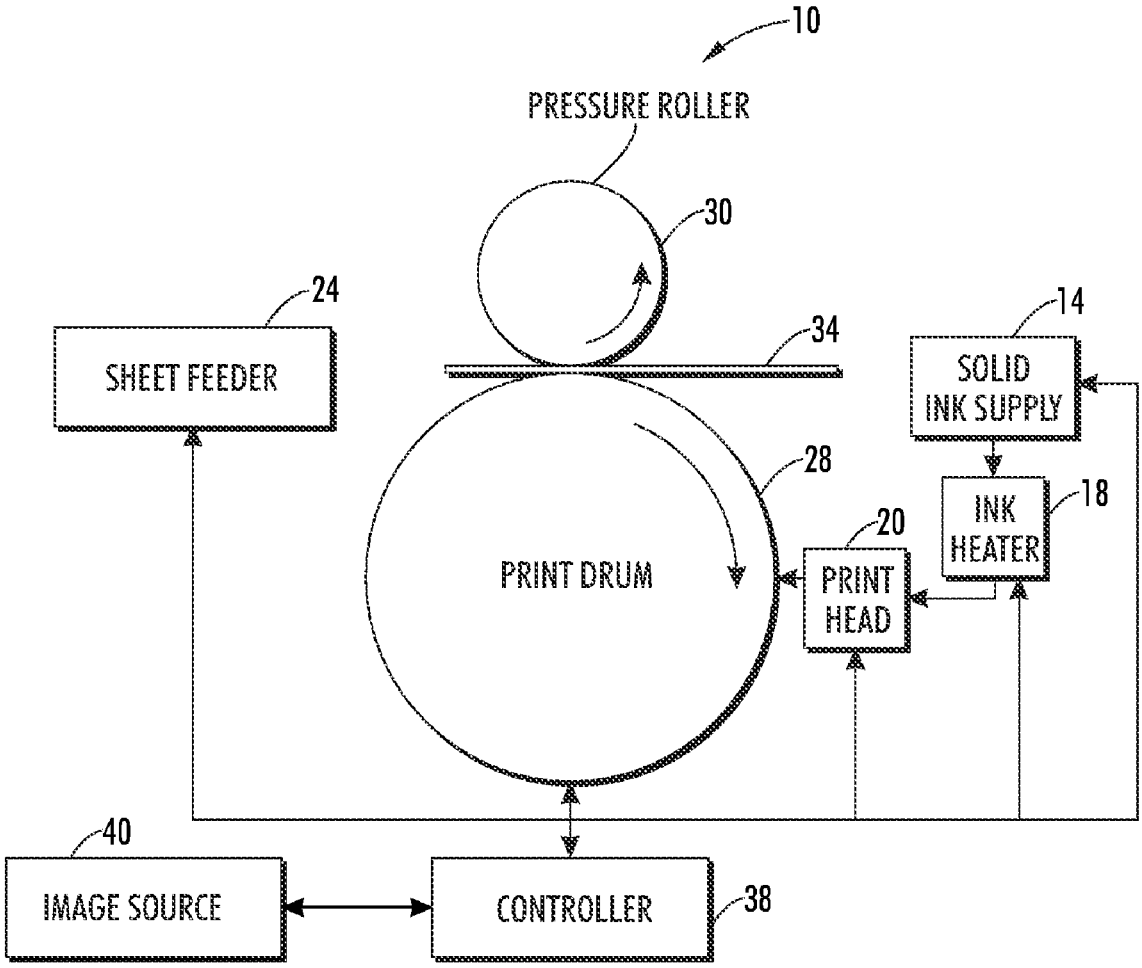
FIG. 2 PRIOR ART
FIG. 2 is a block diagram of an embodiment of a phase change ink print station that may be implemented in the phase change ink imaging device of FIG. 1.

The print station 8 is configured to form images on the print media using a phase change ink imaging process. FIG. 2 depicts a block diagram of an embodiment of a phase change ink imaging device that may be utilized in the print station to form images on the print media with phase change ink. The phase change ink print station has an ink supply 14 which receives and stages solid ink sticks. In one embodiment, the ink supply includes a dedicated channel (not shown) for loading, feeding, and melting solid ink sticks of a particular color. The respective ink channels guide the appropriate colored solid ink sticks to a an ink melting assembly 18 for melting or phase changing the solid form of the phase change ink into a liquid form, and then supplying the liquid phase change ink to the printhead(s). Phase change ink is typically solid at room temperature, i.e., around 25° C. The ink melting assembly is configured to heat the phase change ink to a melting temperature selected to phase change or melt the solid ink to its liquid or melted form. Currently, common phase change inks are typically heated to about 100° C. to 140° C. to melt the solid ink for delivery to the printhead(s). The melting temperature, however, may be any temperature that is capable of phase changing, i.e., melting, phase change ink sticks from solid form to liquid form.

The melted ink is supplied to a printhead assembly 20 by gravity, pump action, or both. The phase change ink print station 8 may be a direct printing device or an offset printing device. In a direct printing device, the ink may be emitted by the print head 20 directly onto the surface of a recording medium. The embodiment of FIG. 2 shows an indirect, or offset, printing device. In offset printers, the ink is emitted onto a transfer surface 28 that is shown in the form of a drum, but could be in the form of a supported endless belt. To facilitate the image transfer process, a heated pressure roller 30 presses the media 34 against the ink on the drum 28 to transfer the ink from the drum 28 to the media 34. The pressure roller and the transfer surface are positioned in relation to each other to form a transfixing nip through which the media is fed. The ink drops on the media are pressed into the media and spread out on the media by the pressure formed by the nip. One or more of the transfer drum and pressure roller may be heated to bring the print media to a fixing temperature that is in a range from about 35° C. to about 80° C. In one practical embodiment, the fixing temperature is about 55° C. For some phase change inks, fixing temperatures that are higher than about 57° C. may cause ink to offset to the roll.

Once melted phase change ink has been deposited on a recording medium, the recording medium may be transferred, delivered, or otherwise moved to a finishing device, or finisher 10. A "finisher" can be any post-printing accessory device such as a tray or trays, sorter, mailbox, inserter, interposer, folder, stapler, stacker, hole puncher, collator, stitcher, binder, envelope stuffer, postage machine, or the like. In particular, the finisher 10 receives the print media from the print station 8. The finisher 10 may be configured to provide various finishes to the print media sheets of a print job or jobs, or even a portion of a print job. Finishes can include, for example, patterns of collation, binding or stapling available by the finisher module. Additional, advanced finishes can include, for example, other binding techniques, shrink wrapping, various folding formats, etc. The finisher 10 can also be provided with multiple output trays (not shown) and the ability to deliver specified print media sheets to a selected output tray or trays. Depending on the specific design of finisher, there may be numerous paths for directing print media to the various finishes and numerous output trays for print sheets, corresponding to different desired actions.

A print media transporting system (not shown) links the feeder 4, print station 8, and finisher 10. The print media transporting system includes a network of media pathways for guiding the movement of the print media through the imaging device 2. The print media transporting system may include drive members, such as pairs of rollers, spherical nips, airjets, or the like. The transport system may further include associated motors for the drive members, belts, guide rods, frames, etc. (not shown), which, in combination with the drive members, serve to convey the print media along selected pathways at selected speeds. In addition, the media transporting system may include inverters, reverters, interposers, bypass pathways, etc. as known in the art to direct the print media to the appropriate positions for processing.

The finishing system may include a folding system 12 that is configured to fold the print media. One difficulty faced in folding print media that have been printed with phase change ink, however, is the breaking or flaking off of ink from the print media. Ink breaking or flaking due to folding may result because the phase change ink tends to remain at the surface of the media which in turn enables images formed on the print media with phase change ink to typically exhibit bright, vibrant colors. However, because the phase change ink is deposited primarily on the surface of the print media, folding the print media may cause the solidified phase change ink to break or flake off the media which degrades the quality of the image on the print media. In addition, ink that has broken or flaked off of the media may contaminate the inside of the finisher or, if the folded print media is being folded for insertion into an envelope, the ink flakes or debris from folding may contaminate the inside of the envelope.

To reduce or prevent the solidified phase change ink that forms images on a print media from breaking or flaking off during folding of the print media, a folding system has been developed that includes a folding heater configured to heat the print media, or at least the ink thereon, immediately prior to or during the folding of the media. Heating the phase change ink on a print media prior to or during the folding of the print media acts to soften the phase change ink which allows the heated ink to move rather than shatter or flake during folding which, in turn, increases the ability of the ink to adhere to the media so that the fold causes less of an undesired visual artifact.

The folding heater of the folding system is configured to apply thermal energy to the print media or the phase change ink thereon in order to heat the ink to a folding temperature that that is greater than ambient or room temperature and less than the melting temperature of the phase change ink. In one embodiment, the folding temperature is any temperature in a range from about 35° C. to about 80° C. The ability of the folding heater to prevent or reduce ink breaking and flaking during folding increases with magnitude of the folding temperature. As mentioned above in connection with the transfixing or fixing assembly, however, higher ink temperatures may cause the ink to offset to surfaces such as rollers or media guides. Accordingly, in one embodiment, the folding temperature generated by the folding heater is greater than ambient temperature and less than the offset temperature of the particular phase change ink utilized in the imaging device. The offset temperature is dependent upon the type or formulation of phase change ink used. In one practical embodiment, the folding temperature is any temperature between approximately 40° C. and 50° C.

Figure 3:
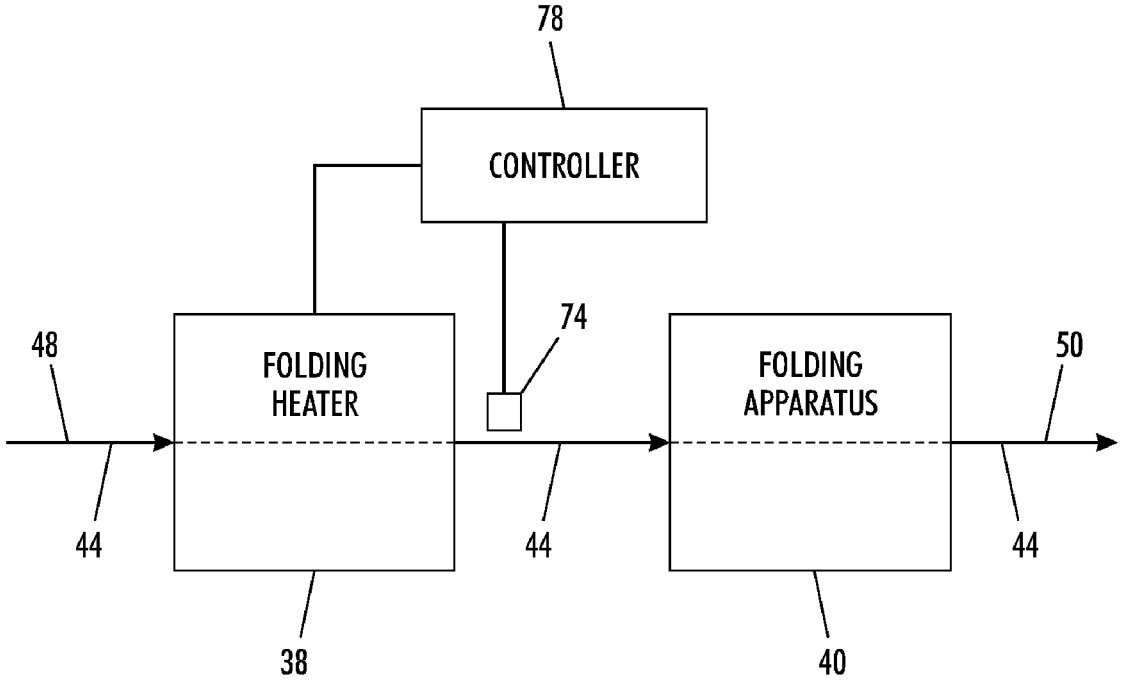
FIG. 3 is a block diagram of a folding system that may be implemented in the finisher of the phase change ink imaging device of FIG. 1.

FIG. 3 is a block diagram of a folding system that may be implemented in the finisher of the phase change ink imaging device described above. The folding system includes a folding heater and a folding apparatus. The folding heater 38 and folding apparatus 40 are arranged along a media pathway 44 that is configured to direct print media into an operable position with respect to the folding heater and folding apparatus. The media pathway 44 includes an input section 48 that is configured to receive print media in a known manner from the print station or from another finishing system in the finisher. The media pathway also includes an output section 50 that is configured to direct folded print media to, for example, an output tray (not shown in FIG. 2).

The folder apparatus 40 can be any combination of hardware elements that enables the sheet to be folded. Mechanical folding of sheets involves doubling the sheet between rollers while applying pressure appropriate to the thickness of the paper to create a sharp fold that substantially eliminates the paper's natural tendency to revert to its original shape. In various exemplary embodiments, the folding apparatus 40 can include any hardware elements, such as fold blades, one or more simple buckle folders, one or more sets of drive rollers, etc, that enable various types of folds to be controllably applied to each sheet on a sheet-to-sheet basis. The type of folds performed by the folder apparatus 40 may include, but is not limited to, c-folds, z-folds, and half-folds.

Figure 4:
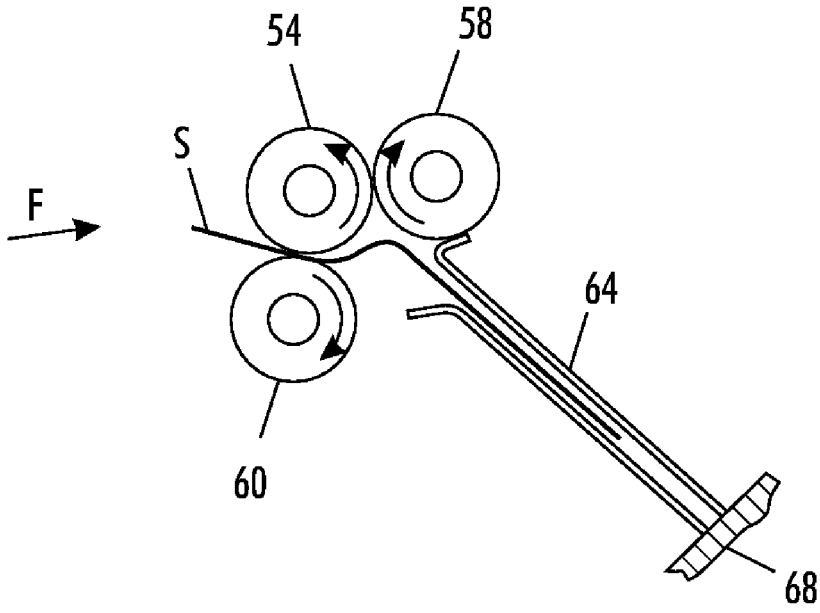
FIG. 4 is a schematic diagram of a buckle folding apparatus.
Figure 5:
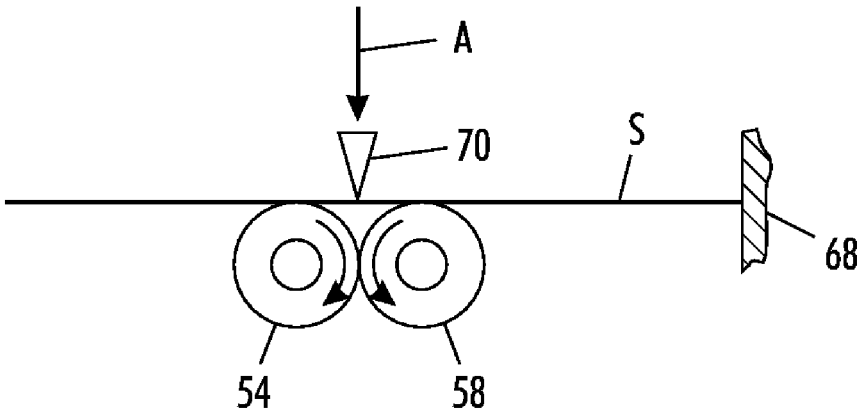
FIG. 5 is a schematic diagram of a blade folding apparatus.

There are two primary methods of generating folds in paper. These are commonly called "buckle folding" and "knife folding". As shown in FIG. 4, buckle folders function by driving a sheet of paper S with drive rollers 54, 60 through a fold chamber 64 against a stop 68, and allowing a controlled buckle to form within an appropriately designed set of baffles. This buckle is drawn into a nip by a pair of fold rollers 54, 58. These rollers usually contact the sheet along most of its width and have a high normal force to insure a tight fold. Knife folders, as shown in FIG. 5, work by registering one or more sheets S adjacent a pair of fold rollers 54, 58 by contacting an edge of the sheet S against a stop 68 and then deflecting the sheet(s) S into the fold nip using a moving "knife edged" bar 70 which is moved in the direction A as shown in FIG. 5. The buckle folding and knife folding devices illustrated in FIGS. 4 and 5 are examples of the types of media folding devices that may be used. Any current or later developed folding device or apparatus, however, may be utilized without straying from the bounds of this disclosure.

Figure 6:
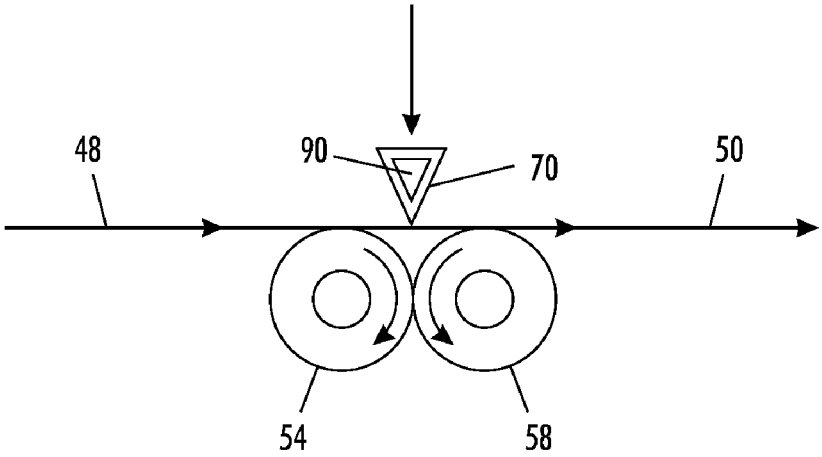
FIG. 6 is a schematic diagram of one embodiment of a folding heater for use with the folding apparatus.

In one embodiment, one or more of the folding surfaces, e.g., fold rollers, fold blade, etc., that contact the print media to perform the folding operation may be provided with heating elements that are configured to heat the particular hardware element to the folding temperature. As mentioned above, the folding temperature may be any suitable temperature between approximately 35° C. to about 80° C., and in one particular embodiment, between approximately 40° C. to about 50° C. In embodiments of the folding apparatus that implement a blade folding operation as depicted in FIG. 6, the fold blade 70 that contacts the print media at the fold line may be heated to the folding temperature. In this embodiment, the fold blade 70 is formed of a thermally conductive material such as aluminum and may be provided with an internal heater such as resistance heating wires or traces 90 disposed within the blade that are configured to heat the fold blade to the folding temperature. The fold blade, however, may be heated to the folding temperature in any suitable manner. For example, the fold blade may be heated by external heaters or a combination of internal and external heaters. Alternatively the tip of the fold blade where the blade touches the part of the media where the fold is formed may be heated to a folding temperature. Here the temperature of the blade should be in a manner that does not cause offsetting of ink onto blade, just enough heat to soften the ink. As an alternative to heating the fold blade, one or more of the folding rollers utilized in either buckle folding or blade folding may be heated in a known manner to the folding temperature. In some embodiments, surface properties of the contact surface of the folding elements, i.e., fold blade or roller surface, may be optimized to reduce ink offset from the print media to the folding element. For example, the folding surfaces may be treated with a release agent such as silicone oil or coated with a material such as Teflon to reduce the ability of the ink to offset to the folding elements.

Figure 7:
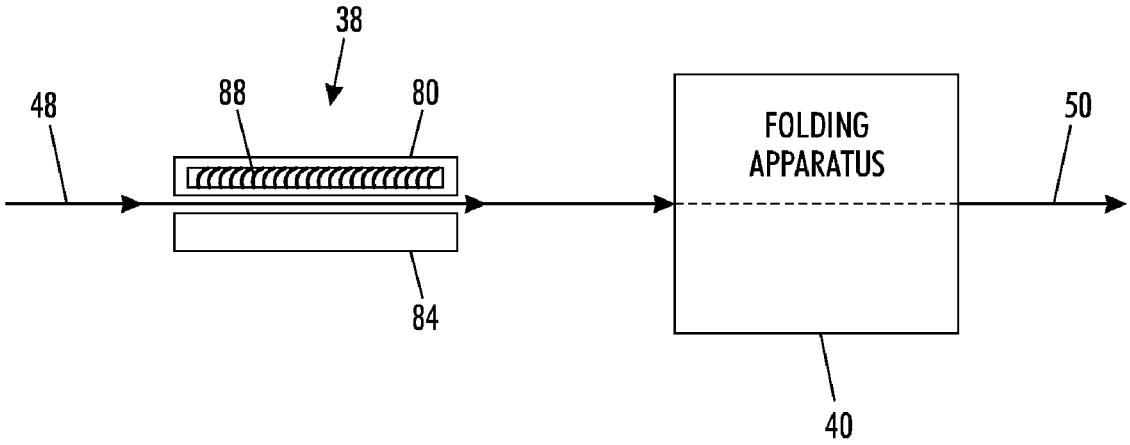
FIG. 7 is a schematic diagram of another embodiment of a folding heater that may be used with the folding apparatus.

As an alternative or in addition to using a heated fold blade or knife to heat the ink while folding, a folding heater may be provided along the media pathway prior to the folding apparatus which is configured to bring the print media to a predetermined folding temperature. The folding heater 38 can rely on contact, radiant, conductive, or convective heat to bring the print media and ink thereon to the folding temperature. Referring to FIG. 7, one embodiment of a folding heater 38 is depicted. In this embodiment, the folding heater comprises heated support plate 80 formed of a thermally conductive material, such as aluminum, having a relatively smooth surface for allowing a relatively frictionless slide of the print media across it and for imparting enough thermal energy for heating the media to the folding temperature. The heater 80 of FIG. 7 is positioned to heat the media on the printed or inked side of the media. A similar heater may be utilized to heat both sides of the print media. Alternatively, a substrate or media guide plate 84 is positioned opposite from the heater plate. The development of thermal energy in the heater plate 80 may be accomplished in any suitable manner such as by resistance heating elements 88, heating lamps, etc. The heater elements 88 of the folding heater are configured to emit thermal radiation to heat the print media in accordance with an electrical current provided by one or more heater power supplies (not shown).

Figure 8:
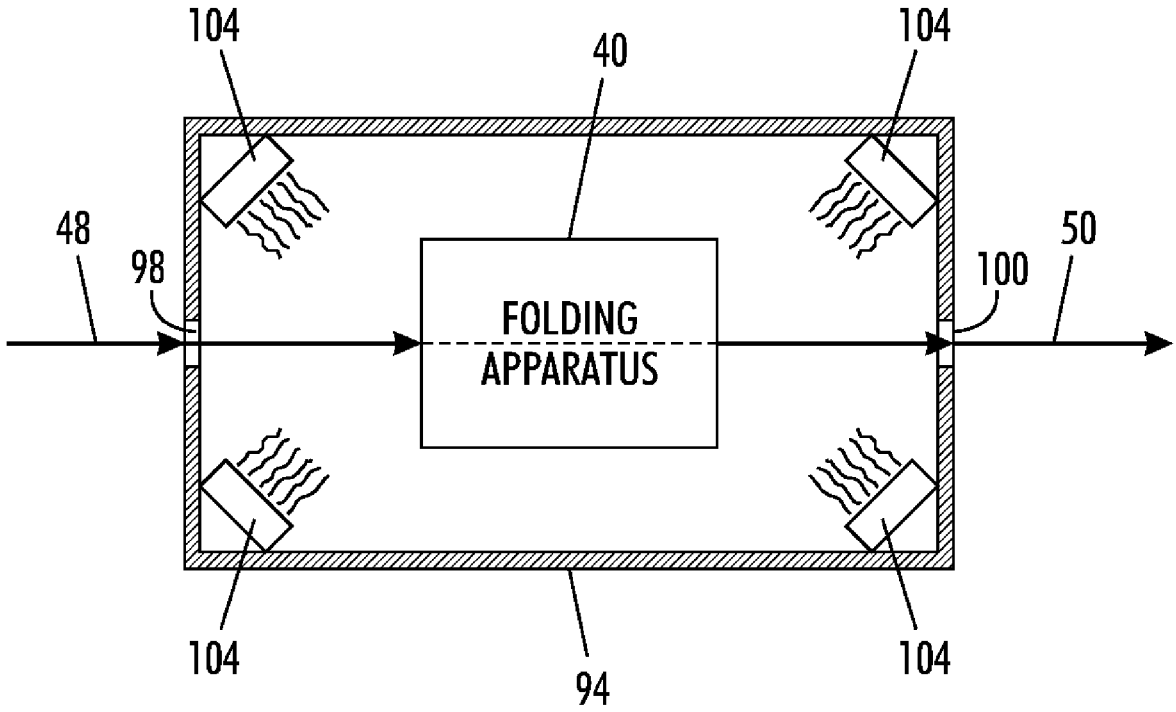
FIG. 8 is a schematic diagram of yet another embodiment of a folding heater that may be used with the folding apparatus.

As an alternative or in addition to the use of a folding heater disposed along the media pathway or a heated fold blade or folding rollers, the print media may be heated to the folding temperature using convection by providing the folding apparatus in a thermally insulated and heated enclosure, or housing. FIG. 8 depicts a simplified cross-sectional view of an embodiment of a folding apparatus 40 and a thermally insulated housing 94 that at least partially surrounds or encloses the folding apparatus. The housing 94 is formed of a plurality of walls that may be formed of any suitable thermally insulated material such as plastic. The housing 94 includes an inlet opening 98 that corresponds to the input section of the folding apparatus to enable print media to be delivered to the folding apparatus disposed in the housing. The housing may also include an outlet opening 100 that permits folded print media to be delivered out of the folder housing and to, for example, an outlet tray. The walls of the housing define a substantially enclosed space B in which the folding apparatus 40 is disposed. The housing includes heating elements 104 for heating the air in the space 18. Any suitable number and type of heating elements may be used to substantially uniformly heat the interior of the housing 94 to a degree that brings the print media to the desired folding temperature. For example, heating elements for heating the space inside the housing may comprise one or more radiant heaters.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A folding system for folding a print media having phase change ink thereon, the system comprising:

a media pathway configured to transport a print substrate having phase change ink thereon;

a folding apparatus disposed along the media pathway configured to fold the print substrate; and a thermally insulated and heated enclosure including at least one heater configured to heat an interior of the enclosure to a degree that brings the print substrate to a folding temperature that is above ambient temperature and below an offset temperature for the phase change ink prior to or during folding of the print substrate by the folding apparatus, the thermally insulated and heated enclosure at least partially encloses the folding apparatus.

2. The folding system of claim 1, the offset temperature being approximately 57° C.

3. The folding system of claim 2, the folding temperature being in a range from approximately 40° C. to approximately 50° C.

4. The folding system of claim 1, the heater comprising a heater plate disposed along at least one side of the media pathway prior to the folding apparatus, the heater plate including a pattern of heating elements for generating heat in the heater plate to bring the print substrate to the folding temperature.

5. The folding system of claim 1, the folding apparatus comprising a buckle folding apparatus.

6. The folding system of claim 1, the folding apparatus including a folding blade and a pair of folding rollers, the folding blade being positioned adjacent the media pathway to contact the print substrate at a predetermined fold line and to push the print substrate at the fold line into a nip formed by the folding rollers.

7. The folding system of claim 6, the folding blade including heating elements disposed therein to heat the folding blade to the folding temperature.

8. A method of folding a print substrate having phase change ink thereon, the method comprising:

transporting a print substrate along a media pathway to a folding apparatus, the print substrate having phase change ink thereon;

heating the phase change ink on the print substrate in a thermally insulated and heated enclosure that at least partially encloses the folding apparatus to a folding temperature that is above ambient temperature and below an offset temperature for the phase change ink, the thermally insulated and heated enclosure including at least one heater configured to heat an interior of the enclosure to a degree that brings the print substrate to the folding temperature prior to or during folding of the print substrate by the folding apparatus; and folding the print substrate using the folding apparatus.

9. The method of claim 8, wherein the offset temperature is approximately 57° C.

10. The method of claim 9, the heating of the phase change ink further comprising:

heating the phase change ink on the print substrate to a folding temperature that is that is between approximately 40° C. to approximately 50° C.

11. The method of claim 8, the heating of the phase change ink further comprising:

heating the phase change ink on the print substrate to the folding temperature using a heater plate disposed along at least one side of the media pathway prior to the folding apparatus, the heater plate including a pattern of heating elements for generating heat in the heater plate to bring the print substrate to the folding temperature.

12. The method of claim 8, the folding of the print substrate further comprising:

folding the print substrate using a folding blade and a pair of folding rollers, the folding blade being positioned adjacent the media pathway to contact the print substrate at a predetermined fold line and to push the print substrate at the fold line into a nip formed by the folding rollers.

13. The method of claim 12, the heating of the phase change ink further comprising:

heating the phase change ink on the print substrate using the folding blade, the folding blade including heating elements disposed therein to heat the folding blade to the folding temperature.

14. A phase change ink imaging device comprising:

a print station configured to deposit phase change ink on a print substrate;

a folding apparatus configured to receive the print substrate from the print station, the folding apparatus being configured to fold the print substrate having the phase change ink thereon; and a thermally insulated and heated enclosure including at least one heater configured to heat an interior of the enclosure to a degree that brings the print substrate to a folding temperature that is above ambient temperature and below an offset temperature for the phase change ink prior to or during folding of the print substrate by the folding apparatus, the thermally insulated and heated enclosure at least partially encloses the folding apparatus.

15. The phase change ink imaging device of claim 14, the folding temperature being in a range from approximately 40° C. to approximately 50° C.

* * * * *